US010729224B2

(12) United States Patent
Kenon et al.

(10) Patent No.: US 10,729,224 B2
(45) Date of Patent: Aug. 4, 2020

(54) PERSONAL GROOMING DRAPE

(71) Applicant: Sphark, LLC, West Palm Beach, FL (US)

(72) Inventors: Carl Kenon, West Palm Beach, FL (US); Anthony Haliburton, West Palm Beach, FL (US)

(73) Assignee: Sphark, LLC, West Palm Beach, FL (US)

( * ) Notice: Subject to any disclaimer, the term of this patent is extended or adjusted under 35 U.S.C. 154(b) by 599 days.

(21) Appl. No.: 15/462,013

(22) Filed: Mar. 17, 2017

(65) Prior Publication Data

US 2017/0265639 A1 Sep. 21, 2017

Related U.S. Application Data

(60) Provisional application No. 62/310,423, filed on Mar. 18, 2016.

(51) Int. Cl.
*A45D 44/16* (2006.01)

(52) U.S. Cl.
CPC ..... *A45D 44/16* (2013.01)

(58) Field of Classification Search
CPC ..... A45D 27/00; A45D 44/16; A45D 44/08; A45F 4/00
See application file for complete search history.

(56) References Cited

U.S. PATENT DOCUMENTS 1,583,998 A * 5/1926 Richey ..... G09B 29/06 40/517
1,688,677 A * 10/1928 Winter ..... G09B 29/003 40/517
2,817,851 A 12/1957 Barnwell
2,892,909 A 6/1959 Darnutzer et al.
3,255,808 A * 6/1966 Schimizzi ..... G09B 29/06 160/245
4,525,946 A * 7/1985 Olson ..... E06B 9/60 160/298
4,689,830 A 9/1987 Williams
5,054,124 A 10/1991 Darvas
5,991,942 A 11/1999 Neal
6,401,246 B1 6/2002 Perez
7,901,213 B1 * 3/2011 Beno ..... B43K 23/001 434/408
8,100,697 B2 * 1/2012 Budryk ..... B43L 1/00 434/412
D687,497 S * 8/2013 Mattaliano ..... D20/42
8,763,181 B1 * 7/2014 Penfold ..... A47G 23/0306 5/420

(Continued)

*Primary Examiner* — Nicholas D Lucchesi
(74) *Attorney, Agent, or Firm* — McHale & Slavin, P.A.

(57) ABSTRACT

The present invention relates to personal grooming drapes, and more particularly to a personal grooming drape that includes an enclosure capable of being secured to a wall surface behind a sink or the like. In a preferred embodiment, the personal grooming drape includes a retractable drape assembly that can be pulled over a counter top, sink basin, or the like to catch, maintain, and dispose of loose fallen hair as the person leans over the drape while grooming facial hair, head hair, or other body hair. After use, the drape is retractable and self-cleaning, and may be supplied with a waste bin that is removable from the enclosure for ease of disposing of the cut hair pieces.

13 Claims, 8 Drawing Sheets

(56) References Cited

U.S. PATENT DOCUMENTS

| | | | | |
|---|---|---|---|---|
| 2005/0243416 | A1* | 11/2005 | Choi | G03B 21/56<br>359/460 |
| 2007/0170340 | A1* | 7/2007 | Almond | A47B 97/08<br>248/454 |
| 2008/0093524 | A1* | 4/2008 | Bertrand | A47B 97/08<br>248/460 |
| 2008/0201840 | A1 | 8/2008 | Hill | |
| 2016/0066674 | A1* | 3/2016 | Szabo | A45D 27/00<br>2/50 |
| 2019/0200734 | A1* | 7/2019 | Neville | A45D 44/16 |

* cited by examiner

PERSONAL GROOMING DRAPE

PRIORITY CLAIM

In accordance with 37 C.F.R. 1.76, a claim of priority is included in an Application Data Sheet filed concurrently herewith. Accordingly, the present invention claims priority to U.S. Provisional Patent Application No. 62/310,423, entitled "PERSONAL GROOMING DRAPE", filed Mar. 18, 2016. The contents of which the above referenced application is incorporated herein by reference.

FIELD OF THE INVENTION

The present invention relates generally to devices for personal hygiene and, more specifically, to a spooled retractable grooming drape for catching hair. The device is adapted to be positioned in front of a person to cover a counter top, sink, basin or the like to catch, maintain, and dispose of loose falling hair as the person leans over the drape while grooming facial hair, head hair or other body hair.

BACKGROUND OF THE INVENTION

Personal hygiene, such as beard trimming, electric shaving, hair cutting and styling, and other body hair grooving and removal methods generate loose and falling hair. Fallen hair often creates undesirable conditions (e.g., unclean, unsanitary, difficult to clean) wherever these grooming activities occur, particularly on, around and within, for example, countertops, sink basins, or the like. Many men prefer to wear mustaches or beards, and well-groomed men keep their facial hair trimmed and neat in appearance. Self-grooming is generally accomplished using scissors, electric razors or trimmers and a mirror. Since mirrors are widely available in bathrooms, typically mounted above a sink basin, men often use these bathroom mirrors to trim their mustaches or beards and use the sink basin to catch the trimmings. These trimmings cause untidy conditions in and around the sink and/or contribute to clogged drains.

Numerous devices have been invented for the purpose of trapping falling pieces of hair. Unfortunately, these devices are generally bulky, uncomfortable to use, and difficult or inconvenient to store. Some devices are disposable, intended for a single or minimal number of uses, whereby the device is disposed of after use, while others are re-usable. For example, U.S. Pat. No. 5,054,124 discloses a disposable device designed to be worn by a person to catch trimmings falling from that person during a hair cut. U.S. Pat. Nos. 2,892,909, 4,689,830 and 6,401,246 disclose functionally similar but non-disposable type devices. These prior art devices generally include a neck band that encircles the entire neck and a cape assembly that is large and bulky connected to the neck band. These devices are worn about the neck of the person being groomed, and cover a large part of the person wearing the device. Thus, these devices are often hot and uncomfortable, and due to a lack of arm holes or sleeves, restrict the person's ability to groom him or herself. When self-grooming, these devices often fail in accomplishing the goal of collecting the falling hair when the person leans over to approach a mirror and causes the drape to swing, dropping any collected hair and causing the drape to miss the falling hair. Thus, these prior art devices are better suited to situations where the person is being groomed by someone else.

Personal grooming devices have also been proposed for covering or protecting a sink basin, as opposed to being worn on the person. For instance, U.S. Pat. No. 5,991,942 is directed to a disposable device which covers a sink to keep liquid and debris off the sink and out of the drain. U.S. Pat. No. 2,817,851 describes a similar disposable device aimed at protecting the user from unsanitary conditions on the sink surfaces. Finally, U.S. Patent Application Publication No. 2008/0201840 discloses a disposable "sink cape" aimed at "dry use" and catching hair trimmings from beard trimming or shaving with an electric razor. Notably, each of these disclosures teach openings in the cover for penetration by the sink's faucet handles and/or faucet, and thus allow debris to land on the penetrating fixtures and to fall through the openings provided. Additionally, they are all disposable devices that would require the user to continuously replace the device after each use.

Thus, while the prior art devices have attempted to address the problem of catching falling hair during personal grooming, they have not met the needs of consumers who desire a product that can be mounted within a bathroom of a home, hotel or the like as a permanent aesthetically appealing fixture. Paramount among such needs is a grooming drape that is self-contained and re-usable. The device should completely protect the area in front of a person during hair grooming, such as for example, the countertop, sink basin, or the like; and upon completion of self-grooming, facilitate easy collection and removal of the fallen hair.

SUMMARY OF THE INVENTION

The present invention relates to personal grooming drapes and, more particularly, to a personal grooming drape that includes an enclosure capable of being secured to a wall surface behind a sink or the like. In a preferred embodiment, the personal grooming drape includes a retractable drape assembly that can be pulled over a counter top, sink basin, or the like to catch, maintain, and dispose of loose fallen hair as the person leans over the drape while grooming facial hair, head hair, or other body hair. After use, the drape is retractable and self-cleaning, and may be supplied with a drawer that is removable from the enclosure for ease of disposing of the cut hair pieces. The retractable grooming drape apparatus generally includes an enclosure and a retractable drape assembly. The enclosure includes a rear wall constructed for securement to a wall surface, a pair of sidewalk, top and bottom walls, and a pivotable front wall. A spooled retractable drape is positioned within the enclosure, having a front edge of the drape secured to a handle assembly and the back edge of the drape fixed to the spool. The drape is, thus, capable of being extended from and retracted into the enclosure. A spring loaded winding mechanism, or other suitable winding mechanism, is positioned within the spool to allow easy deployment and retraction. Thus, the front wall is positioned in a closed position to form a portion of the enclosure. The handle member, attached to the drape and a support assembly for the drape, is pulled away from the enclosure to extend the drape over the top of a countertop, sink, basin, or the like to collect fatten hair during a grooming process. Upon completion of the grooming process, the drape is retractable onto the spool by pushing inward on the handle, simultaneously disposing of the collected hair into the enclosure bottom wall defined as a waste bin.

Accordingly, it is an objective of the present invention to provide a personal grooming drape apparatus for collecting hair from grooming which facilitates in easy collection and disposal of the fallen hair.

It is another objective of the present invention to provide a personal grooming drape that is lightweight, easily assembled, and inexpensive to manufacture.

Yet another objective of the present invention is to provide a personal grooming drape that can be easily mounted within a new or pre-existing bathroom or make-up area.

Still another objective of the present invention is to provide a personal grooming drape that provides a self-cleaning operation.

Still yet another objective of the present invention is to provide a personal grooming drape that is constructed to extend over the top of a typical sink and faucet construction to prevent drain clogging.

An even further objective of the present invention is to provide a personal grooming drape which utilizes a spooled retractable drape assembly for easy deployment and retraction of the drape for compact storage of the device.

Other objects and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Figure 1:
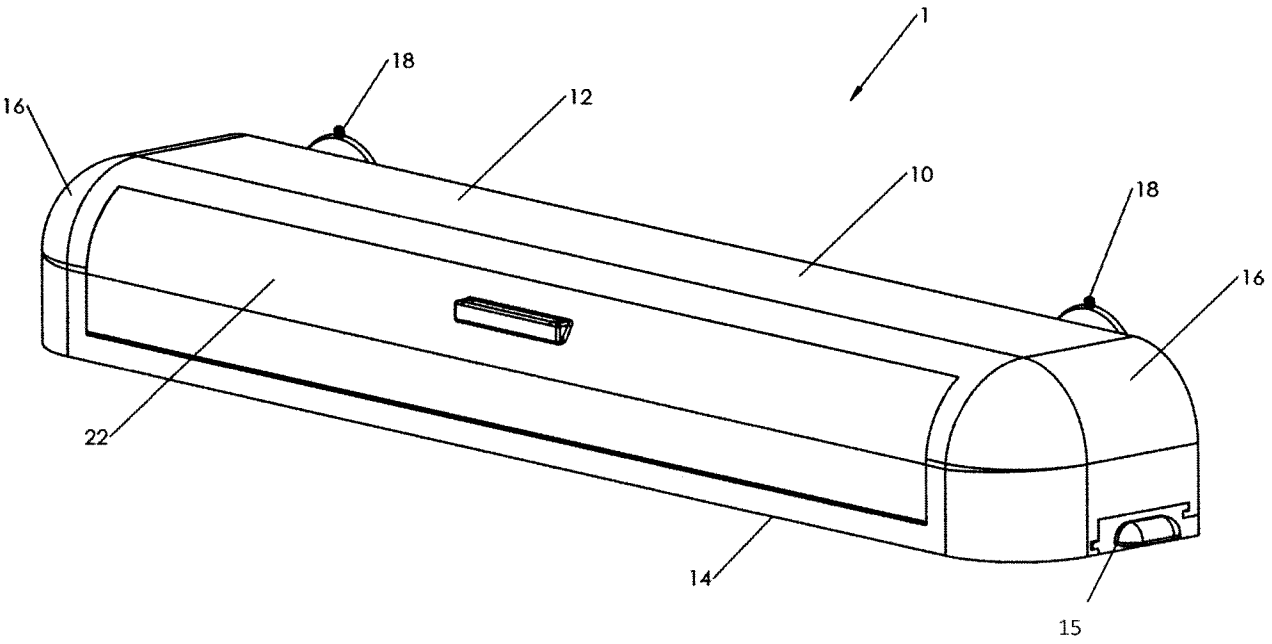
FIG. 1 is an isometric front view of the retractable grooming drape apparatus of the present invention.
Figure 2:
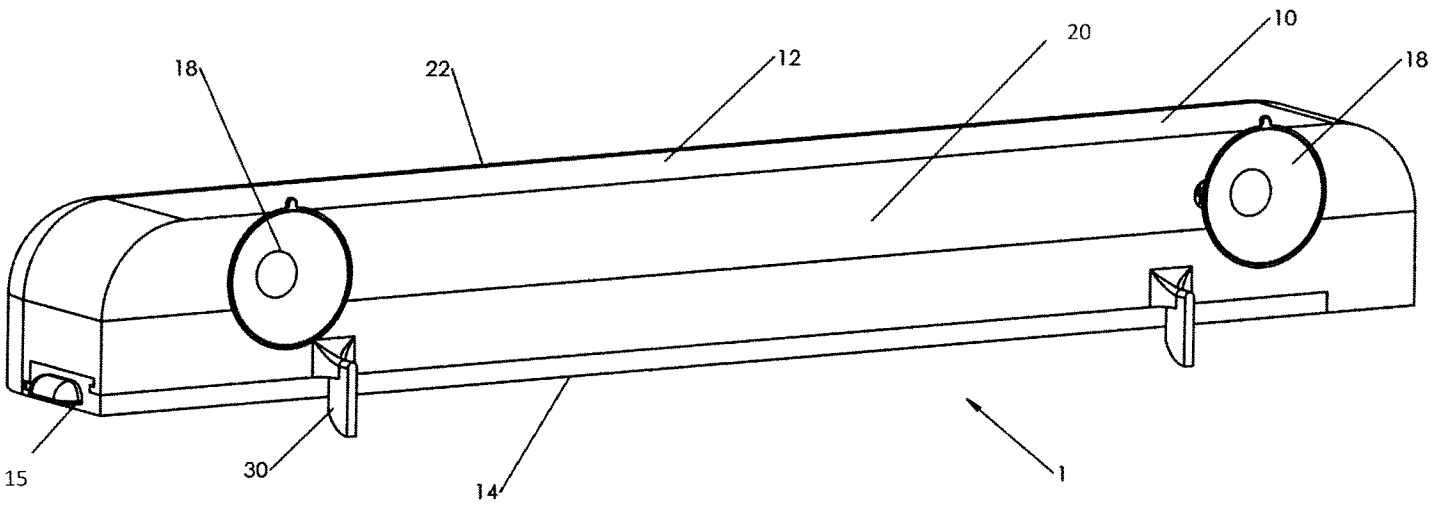
FIG. 2 is an isometric back view of the retractable grooming drape apparatus.

While the present invention is susceptible of embodiments in various forms, there is shown in the drawings and will hereinafter be described a presently preferred, albeit not limiting, embodiment with the understanding that the present disclosure is to be considered an exemplification of the present invention and is not intended to limit the invention to the specific embodiments illustrated.

Referring now to the FIGS. 1-8, a grooving drape apparatus 1 for catching hair clippings is illustrated. The grooming drape 1 includes a retractable drape 50 that is extendable to be positioned in front of a person to cover a sink basin, countertop, surface, or the like to catch, maintain, and dispose of hair clippings as the user leans over the drape 50 while grooming facial hair, head hair, or other body hair. Once the person is finished grooming, the drape 50 is retracted into the closure where the drape is automatically cleaned and stored for the next use while the hair clippings are deposited into a portion of the bottom wall 14, described herein as a waste bin 15. In one embodiment, the grooming drape apparatus 1 includes an enclosure 10 that is constructed and arranged to be permanently or temporarily secured to a vertical wall. In this manner, the grooming drape may be positioned at any convenient height which may cover other fixtures such as sinks and the like. The enclosure 10 is comprised of a top wall 12, a bottom wall 14, waste bin 15, a pair of sidewalls 16, a rear wall 20, and a front wall 22, wherein the front wall 22 is pivotable to define an internal cavity 28. Inside of the enclosure 10, within the internal cavity, is a spring loaded spool 40, a drape 50, a support assembly 70 and a waste bin 15. The interior surface of the sidewalk 16 includes a mounting plate 44 that is constructed and arranged for securing the spool 40 to the sidewalls 16 in a manner that allows the spool 40 to rotate for deployment and retraction of the drape 50. Thus, the spool 40 is secured within the enclosure 10 for rotation along an axis of rotation 42. A spring mechanism 45, such as those used for window blinds, is preferably included within the spool to provide rolled up retraction of the drape 50. Thus, the drape 50 is capable of being extended from and retracted into the enclosure 10 for winding about the spool 40 when the handle 57 and support assembly 70 is moved away or toward the enclosure 10 respectively. The back edge of the drape 50 is fixed to an elongated groove 47 provided on the spool 40, while the front 54 of the drape 50 is secured to a handle member 57 of the support assembly 70 for extending the drape 50 over a sink basin or cabinet top when the support assembly 70 is extended away from the enclosure. In the preferred embodiment, the support assembly 70 includes a handle member 57 having a front plate 56 that allows the drape 50 to be attached along its entire front edge 54 to provide support and even tension on the drape during movement thereof. The front plate 56 allows the front edge 49 of the drape 50 to be secured in a variety of ways including, but not limited to, fasteners, adhesives, pinch plates and the like. The spring assembly 60 is positioned within the spool 40 and is operable to allow the spool 40 to be rotated in a first direction, whereby the drape 50 can be extended out of the enclosure 10, winding an internal spring (not shown) to a first position 62 whereby the spring is locked. Pulling the handle outward again a small amount releases the spring and allows the drape 50 to be rewound about the spool 40 and thus drawn into the enclosure 10 for storage. It should be noted that while an automatic retraction mechanism is illustrated in the preferred embodiment, other retraction mechanisms may be utilized without departing from the scope of the invention. Such retraction mechanisms may include, but should not be limited to, manually operated knobs, levers, cranks, electric motors, and the like.

Still referring to FIGS. 1-8, the enclosure 10 can also include mounting means 18 on the outside surface of the rear wall 20 for support and securement to a surface. The mounting means 18 can include, but is not limited to, suction cups, braces, clamps, fasteners or the like that can be constructed for permanent securement or temporary securement onto a surface. The preferred embodiment utilizes suctions cups as a mounting means to a surface in combination with at least one wall plate 30. In this manner, the suction cup allows the present device to be secured to any smooth surface while the wall plate presses against the surface in a cantilever fashion to provide stability and rigidity to the device. Thus, as the drape is extended, the wall plate(s) 30 are pressed tighter against the wall surface, adding stability to the device to maintain perpendicularity to the wall surface and prevent the drape 50 from sagging due to being extended. It should be noted that, while the mounting means are illustrated as being secured to the rear surface of the enclosure, the sides, top, or bottom surfaces of the enclosure may be utilized for the mounting means without departing from the scope of the invention. The mounting means may be the suction cups as illustrated or, alternatively, may be rubber feet or the like that provide stability to the device and generally prevent movement of the device as the drape is extended and/or retracted from the enclosure. The interior surface of the sidewalk 16 includes a mounting plate 44 that is constructed and arranged for securing the spool 40 to the sidewalls 16 in a manner that allows the spool 40 to rotate for deployment and retraction of the drape 50.

In a preferred embodiment, the bottom wall 14 of the enclosure 10 is constructed to include a waste bin 15 for collecting and holding the fallen hair that has been dispensed from the drape 50 upon retraction thereof. The drape 50 is preferably of a sufficient length to cover an entire sink basin, cabinet top or the like. The drape 50 is constructed of a polymeric material that is substantially static free to release the fallen hair fragments upon retraction of the drape 50; such materials are well known for use in construction ponchos that are utilized by barbers and hair dressers. In an alternative embodiment (not shown), the enclosure can further include a heat bar, laser or the like on the interior of the rear wall, whereby fallen hair is burned off when the fallen hair is dispensed from the retracted drape into the waste bin. The waste bin 15 can be detachable to empty the fallen hair waste collected over time, shown in FIG. 8. The detachable waste bin 15 allows for easy clean-up. In the preferred embodiment, the enclosure 10 is constructed from plastic materials to construct a lightweight and robust structure. However, it should be noted that other materials including, but not limited to, wood, metal, rubber, stone, paper or suitable combinations thereof may be used, so long as the retractable grooming drape apparatus 1 remains sufficiently lightweight to be maneuvered by a single person. It should also be noted that while the device is illustrated as a portable device the grooming drape apparatus could be built into cabinetry as a permanent fixture without departing from the scope of the art.

Figure 3:
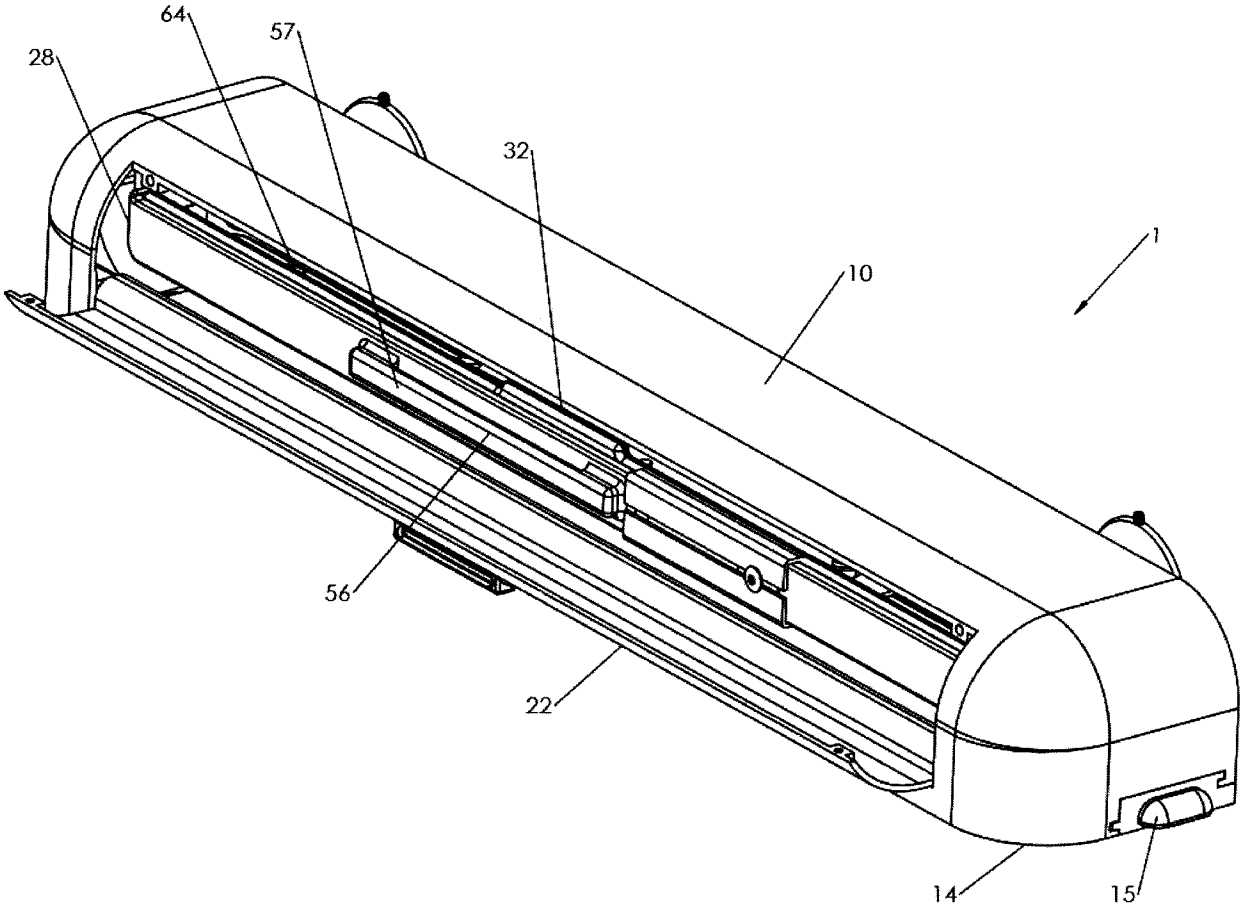
FIG. 3 is an isometric front view of the retractable grooming drape apparatus illustrating the front wall in an open position.
Figure 4:
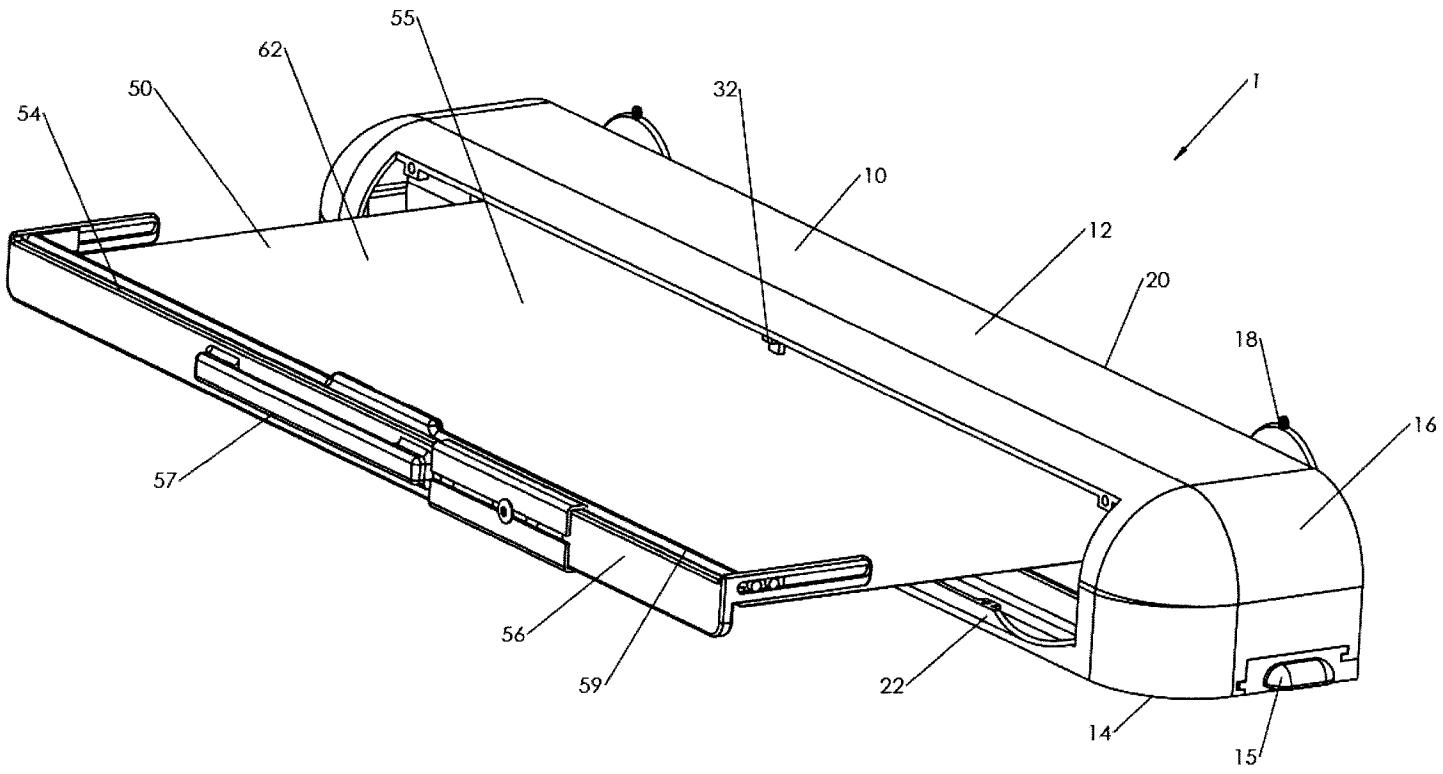
FIG. 4 is an isometric front view of the retractable grooming drape apparatus illustrating the front wall opened and the drape in a partially open position.
Figure 5:
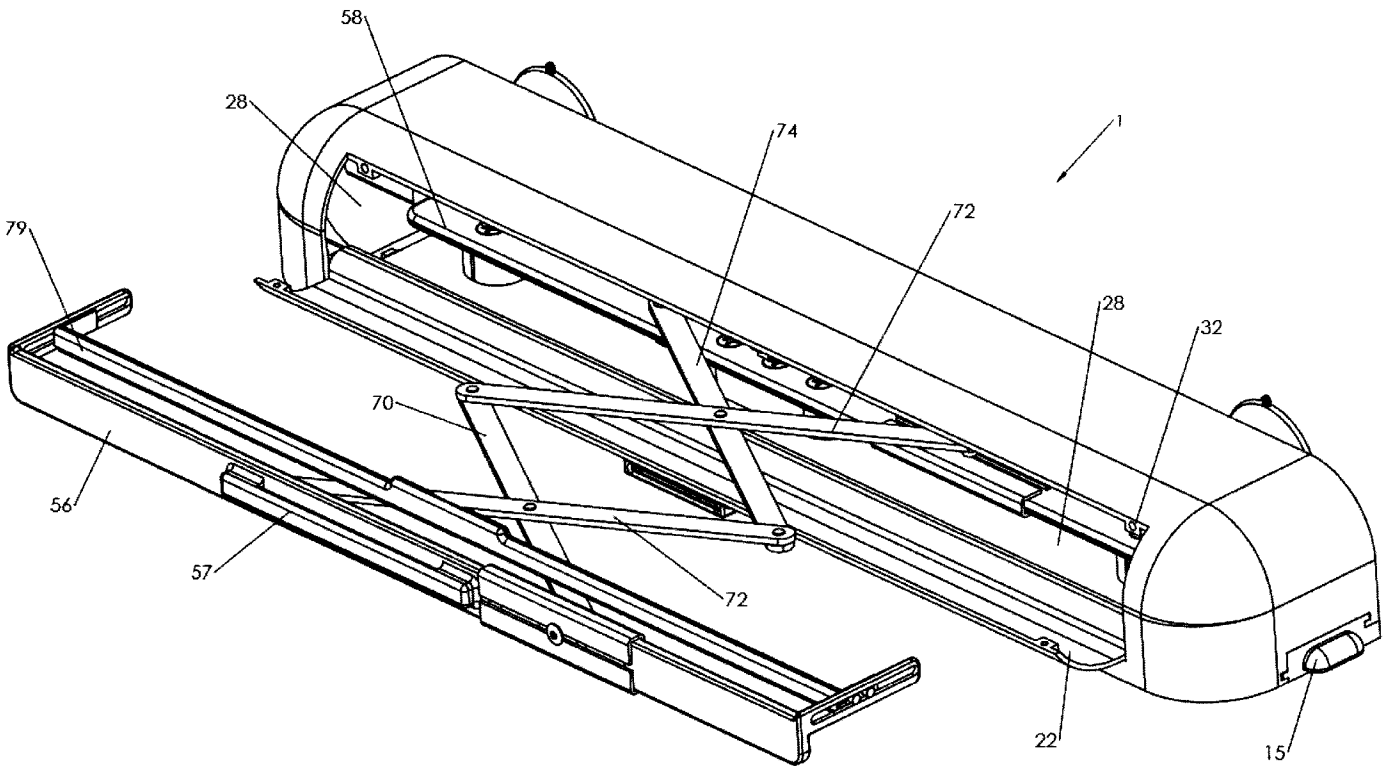
FIG. 5 is a partial isometric front view, having the drape omitted for clarity, illustrating the drape support linkage assembly.
Figure 6:
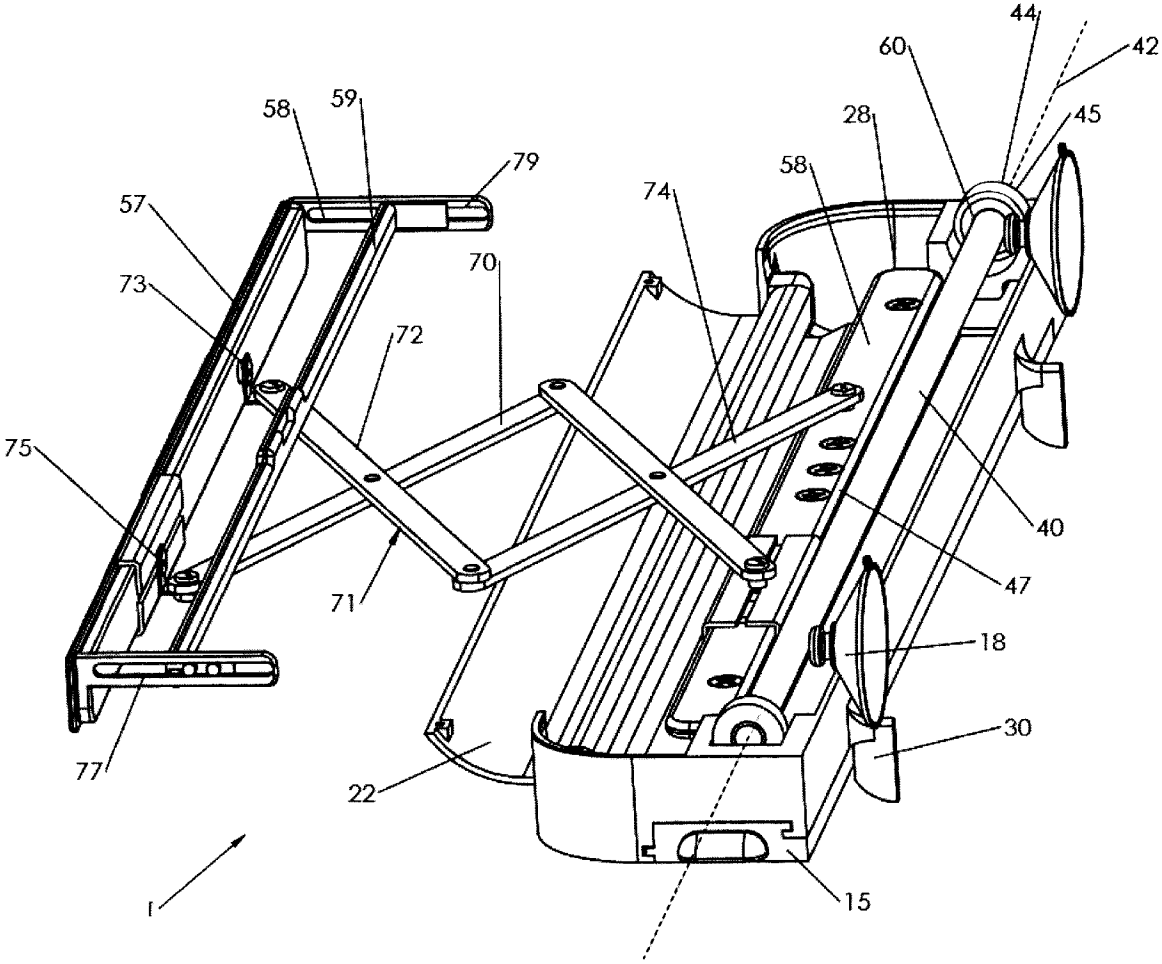
FIG. 6 is a partial right side isometric view, having the top wall omitted, illustrating the drape support linkage assembly in a fully extended position, also illustrated is the drape roll.
Figure 7:
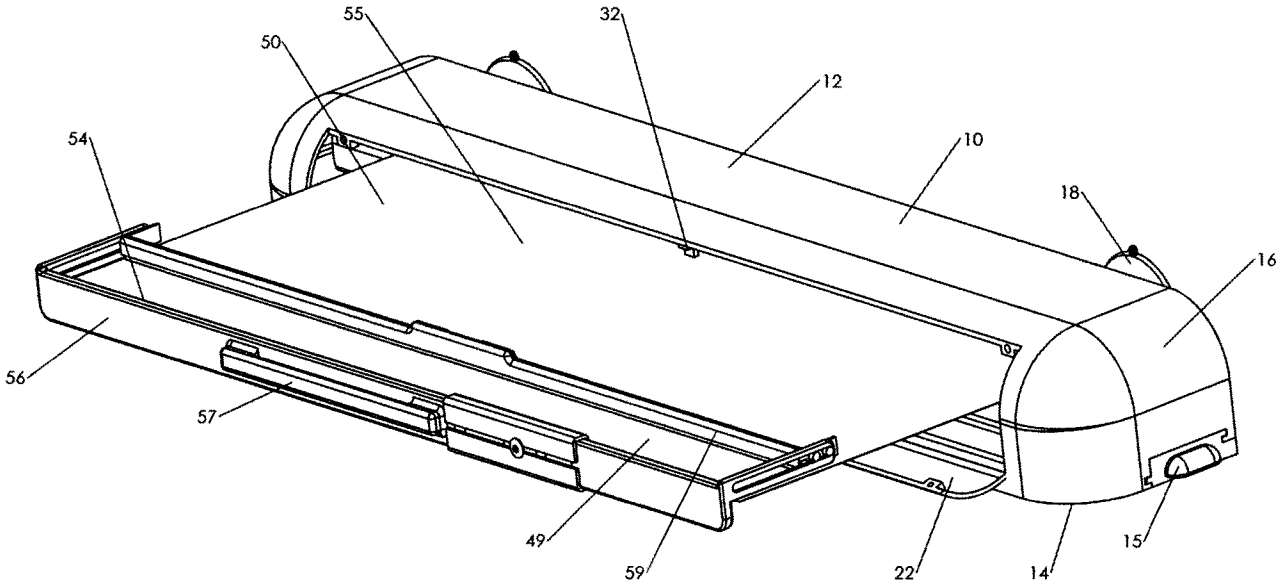
FIG. 7 is an isometric front view of one embodiment of the retractable grooming drape apparatus illustrating the drape in an extended position and a hair rake pulled inwardly.
Figure 8:
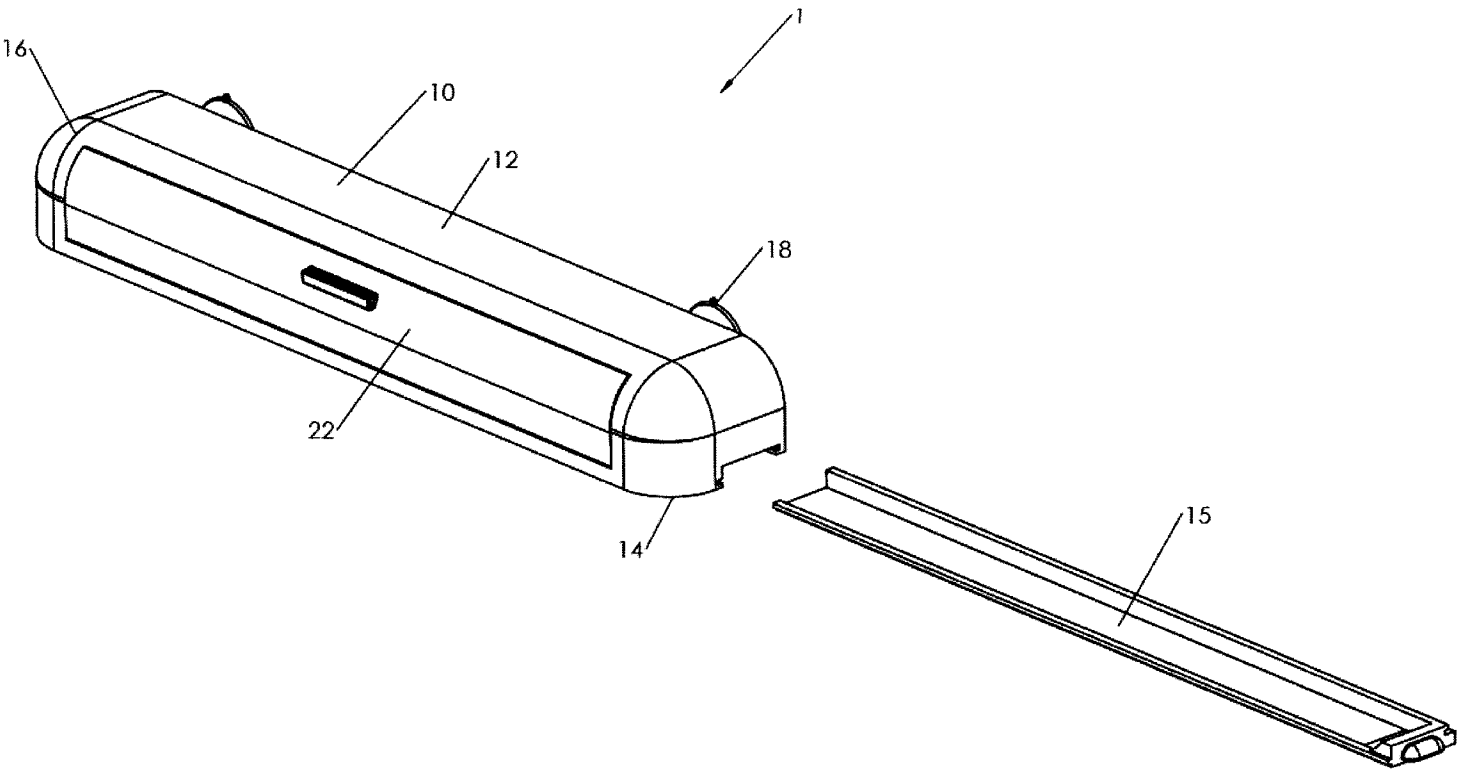
FIG. 8 is a front isometric view of the retractable grooming drape apparatus having the bottom wall or waste bin removed.

As shown in FIGS. 3 through 6, the spool 40 is within the enclosure 10 and arranged for rotation relative thereto about an axis 42. The drape 50 is capable of being extended from and retracted into the enclosure 10 about the spool 40 when the front wall 22 is pivoted outwardly with respect to the enclosure 10, shown in FIG. 4. The retraction mechanism 60 is positioned within the spool 40 to allow free rotation and retraction of the spool 40. The handle member 57 and front plate 56 is selectively operable between a first position, as shown in FIG. 3, to a second position, as shown in FIGS. 4-6. In general, the support assembly provides a structure whereby the front portion of the enclosure may be extended outwardly away from the enclosure to support the drape in a sufficiently flat arrangement to allow hair clippings to be supported upon the top surface of the drape. The support assembly 70 includes the front plate 56, having the front edge 49 of the drape 50 fixed to an inner surface thereof, a pair of slide assemblies 58, and a linkage assembly 71 that is expandable and retractable relative to the enclosure and the handle 57, as illustrated in FIGS. 5 and 6. In the preferred embodiment, a pair of scissor type links 72, 74 are utilized. The first link 72 includes one pivoting but fixed arm 73 and one slidably mounted anti 75, while the second link 74 also includes one pivoting but fixed arm 73 and one slidably mounted arm 75 which cooperate to allow the front plate 56 and thus the drape 50 to be extended outwardly from the enclosure 10 without binding of the assemblies. It should be noted that while the scissor type links are illustrated, other linkages and assemblies that would allow the front plate 56 and drape 50 to be extended and retracted to and from the enclosure respectively may be utilized without departing from the scope of the invention. Such linkages and assemblies include, but should not be limited to rails, slides, telescoping assemblies, or suitable combinations thereof (not shown).

Referring to FIGS. 4-7, one embodiment of the present invention is illustrated. In this embodiment, a slidable rake 59 is secured to the inner wall of the front plate 56. The slidable rake 59 allows for fallen hair that is located nearest the front edge 54 of the drape 50 to be pushed towards the center portion 55 of the drape 50 to facilitate disposal of the fallen hair on the drape 50 when the drape 50 is retracted onto the spool 40. The center portion 55 of the drape 50 is otherwise defined as the "drop zone" because the fallen hair that sits on the center portion 55 will be disposed into the waste bin 15 when the drape 50 is retracted onto the spool 40. The rake 59 is movable from a position nearest to the front edge 54 of the drape to a position towards the center portion 55 of the drape. The rake 59 is manually pushed towards the center portion 55 along guiderails 77 and 79. When handle 57 is pushed back into the enclosure 10 and the drape 50 is retracted, a backstop 32 on the interior surface of the top wall 12 of the enclosure 10 forces the rake 59 back into its original position nearest the front edge 54 of the drape 50, shown in FIG. 7. In an alternative embodiment the handle and front plate are pivotable so that the front plate and handle rotate at the enclosure to a vertical position to eliminate the need for the rake by allowing gravity cause the loose hair to fall into the bottom of the enclosure.

In use, a user would pivot the front wall 22 on the enclosure 10 to an open position and pull the handle 57 outwardly away from the enclosure 10, thereby extending the drape 50; the user would then shave or trim as desired and allow the hair pieces to fall onto the drape 50. Once the user is finished shaving, the user would slide the rake 59 inwardly towards the enclosure 10 to push the Men hair located near the front edge 54 of the drape 50 towards the center portion 55 of the drape 50 so that the fallen hair is in the drop zone when the drape 50 is fully retracted about the spool 40. Then the user would push the handle 57 back into the enclosure 10. As the drape 50 is retracted, a backstop 32 on the interior surface of the top wall 12 of the enclosure 10 will force the rake 59 back into its original position; the handle 57 will continue to be pushed into the enclosure 10 so that all the hair pieces will fall into the waste bin 15. Lastly, the front wall 22 is pivoted closed. After a number of uses, the user should remove the waste bin 15 to empty out all the hair pieces. Once the waste bin 15 is emptied, it should be slid back into the enclosure 10.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention, and the invention is not to be considered limited to What is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A grooming drape apparatus for catching hair comprising:

an enclosure, said enclosure having a top wall, a bottom wall, a pair of sidewalls, a rear wall, and a front wall defining an inner cavity, said enclosure constructed and arranged to be secured to a vertical wall, said rear wall includes a pair of suction cups, said rear wall includes at least one wall plate extending outwardly with respect to said rear wall, said at least one wall plate positioned below said pair of suction cups so that the weight of said grooming drape apparatus causes said at least one wall plate to press against the vertical wall in a cantilever fashion;

a spool having an axis of rotation housed within said inner cavity and arranged for rotation about said axis of rotation;

a drape having a first end secured to said spool, a center portion wrapped around said spool and a second end secured to a handle member, whereby said handle member can be utilized to extend said drape outward from said enclosure; and a support assembly, said support assembly having a first position within said inner cavity and a second position extending outwardly from said inner cavity, said support assembly arranged to support said drape substantially parallel to a ground surface when extended outwardly from said enclosure to catch and retain loose hair pieces dropped upon said drape.

2. The grooming drape apparatus of claim 1 wherein said drape is constructed from a material to which hair pieces do not stick, whereby said loose hair pieces are dropped into said enclosure as said drape is wrapped around said spool.

3. The grooming drape apparatus of claim 1 wherein said spool is spring loaded whereby extension of said drape loads said spring so that release of said spring causes said drape to be retracted and rewound about said spool.

4. The grooming drape apparatus of claim 3 wherein said spool includes an elongated groove extending along the length of the spool, said first end of said drape secured within said groove.

5. The grooming drape apparatus of claim 1 wherein said handle member includes a front plate, said front plate having an inner surface, a second end of said drape secured to said inner surface to provide support to said drape when extended.

6. The grooming drape apparatus of claim 5 wherein said front plate includes a pair of guiderails for slidably supporting a rake member, said rake member positioned to engage a top surface of said drape whereby said rake can be slid to push said loose pieces of hair off said top surface of said drape, said loose pieces of hair pushed towards said center portion of said drape to facilitate disposal of said loose hair when said drape is retracted onto said spool.

7. The grooming drape apparatus of claim 6 wherein a backstop on the interior surface of said enclosure forces said rake back into a position nearest said second end of said drape when said handle is pushed back into said enclosure and said drape is retracted.

8. The grooming drape apparatus of claim 1 wherein said support assembly includes a linkage assembly that is expandable and retractable relative to said enclosure and said handle.

9. The grooming drape apparatus of claim 8 wherein said linkage assembly includes a first and a second pair of scissor links, whereby each of said first and said second pair of scissor links includes a pivoting arm and a slidably mounted arm having a pivot pin positioned close to the center of a first set of pivoting arms in a crossed arrangement defining a first end of each said pair of scissor links, said first end of said first pair of scissor links are secured to said enclosure at a first end and a first end of said second pair of said scissor links are secured at the opposite end of said enclosure, a second end of each said first and said second pair of scissor links including a second set of said pivoting arms and said slidably mounted arms having a pivot pin positioned close to the center of the second pair of scissor link arms in a crossed arrangement.

10. The grooming drape apparatus of claim 1 wherein said bottom wall of said enclosure includes a waste bin, said waste bin removable and replaceable to said enclosure.

11. A grooming drape apparatus for catching hair comprising:

an enclosure, said enclosure having an inner cavity;

a spool having an axis of rotation housed within said inner cavity and arranged for rotation about said axis of rotation, said spool spring loaded whereby extension of said drape loads said spring so that release of said spring causes said drape to be retracted and rewound about said spool, said spool includes an elongated groove extending along the length of the spool, said first end of said drape secured within said groove;

a drape having a first end secured to said spool, a center portion wrapped around said spool and a second end secured to a handle member, whereby said handle member can be utilized to extend said drape outward from said enclosure; and a support assembly, said support assembly having a first position within said inner cavity and a second position extending outwardly from said inner cavity, said support assembly arranged to support said drape substantially parallel to a ground surface when extended outwardly from said enclosure to catch and retain loose hair pieces dropped upon said drape.

12. A grooming drape apparatus for catching hair comprising:

an enclosure, said enclosure having an inner cavity;

a spool having an axis of rotation housed within said inner cavity and arranged for rotation about said axis of rotation;

a drape having a first end secured to said spool, a center portion wrapped around said spool and a second end secured to a handle member, whereby said handle member can be utilized to extend said drape outward from said enclosure, said handle member includes a front plate, said front plate having an inner surface, a second end of said drape secured to said inner surface to provide support to said drape when extended, said front plate includes a pair of guiderails for slidably supporting a rake member, said rake member positioned to engage a top surface of said drape whereby said rake can be slid to push said loose pieces of hair off said top surface of said drape and towards said center portion of said drape to facilitate disposal of said loose hair when said drape is retracted onto said spool; and a support assembly, said support assembly having a first position within said inner cavity and a second position extending outwardly from said inner cavity, said support assembly arranged to support said drape substantially parallel to a ground surface when extended outwardly from said enclosure to catch and retain loose hair pieces dropped upon said drape.

13. A grooming drape apparatus for catching hair comprising:

an enclosure, said enclosure having an inner cavity;

a spool having an axis of rotation housed within said inner cavity and arranged for rotation about said axis of rotation;

a drape having a first end secured to said spool, a center portion wrapped around said spool and a second end secured to a handle member, whereby said handle member can be utilized to extend said drape outward from said enclosure; and a support assembly, said support assembly having a first position within said inner cavity and a second position extending outwardly from said inner cavity, said support assembly arranged to support said drape substantially parallel to a ground surface when extended outwardly from said enclosure to catch and retain loose hair pieces dropped upon said drape, said support assembly includes a linkage assembly that is expandable and retractable relative to said enclosure and said handle.

* * * * *